United States Patent [19]

Loftis

[11] 3,966,053

[45] June 29, 1976

[54] DRILLING APPARATUS

[75] Inventor: James B. Loftis, Remlap, Ala.

[73] Assignee: Joy Manufacturing Company, Pittsburgh, Pa.

[22] Filed: Apr. 25, 1975

[21] Appl. No.: 571,854

Related U.S. Application Data

[62] Division of Ser. No. 470,577, May 16, 1974, abandoned.

[52] U.S. Cl. ..... 211/60 S; 175/85; 175/52; 211/1.5

[51] Int. Cl.[2] ..... E21B 19/14

[58] Field of Search ..... 175/52, 85; 211/60 S

[56] References Cited

UNITED STATES PATENTS

| | | | |
|---|---|---|---|
| 2,781,185 | 2/1957 | Robbins | 175/85 X |
| 3,025,918 | 3/1962 | Leven | 175/85 X |
| 3,157,286 | 11/1964 | Gyongyosi | 211/60 S |
| 3,181,630 | 5/1965 | Coburn | 175/85 |
| 3,212,593 | 10/1965 | Reischl | 211/60 S |

*Primary Examiner*—Ernest R. Purser
*Assistant Examiner*—Richard E. Favreau

[57] ABSTRACT

A drilling apparatus and more particularly a drilling apparatus having improved drill pipe storage and handling means therefor.

8 Claims, 3 Drawing Figures

26
12
II
24
28
30
10
20
30'
22
30'
36
30'
14
II
16
18

33
40
44
36
106
104
112
110
114
102b
58
60
115
116
22
111
20
32
102c
34
52
62
30'
38
102
64
66
III
70
68
III
84
102a
56
108
54
100
98
101
46
42
35
48
50

DRILLING APPARATUS

This application is a division of copending application Ser. No. 470,577 filed May 16, 1974, and now abandoned Drilling rigs such as blast hole drills and the like have commonly been provided in the prior art for boring deep holes into the earth. For example, in one known form such drilling rigs have comprised an elongated, generally vertical drilling assembly carried by a mobile base and adapted to impart a rotary drilling action to an elongated drill string comprised of a plurality of drill pipe sections connected end to end. In practice, such a drill string has often been assembled as drilling progressed from individual drill pipe sections carried by the drilling apparatus on racks or other suitable means, each respective drill pipe section being connected into the drill string after the preceding sections forming the drill string have been driven into the earth. This approach to drilling operations has often been subject to certain undesirable deficiencies, for example deficiencies in prior art drill pipe rack means and the resulting difficulties encountered in storing and manipulating the plurality of individual drill pipe sections used to form the drill string. Specifically, prior art drill pipe storage racks often have not been well adapted to positively secure the pipe sections therein and have not proven convenient for connecting and disconnecting pipe sections in the drill string.

By virtue of the present invention there is provided a drilling apparatus including drill pipe storage rack means having improved means for securing drill pipe sections therein whereby numerous deficiencies of prior drill pipe rack means, including those cited hereinabove, are effectively alleviated. This and other objects and advantages of the present invention are more fully specified in the following description with reference to the accompanying figures, wherein.

Figure 1:
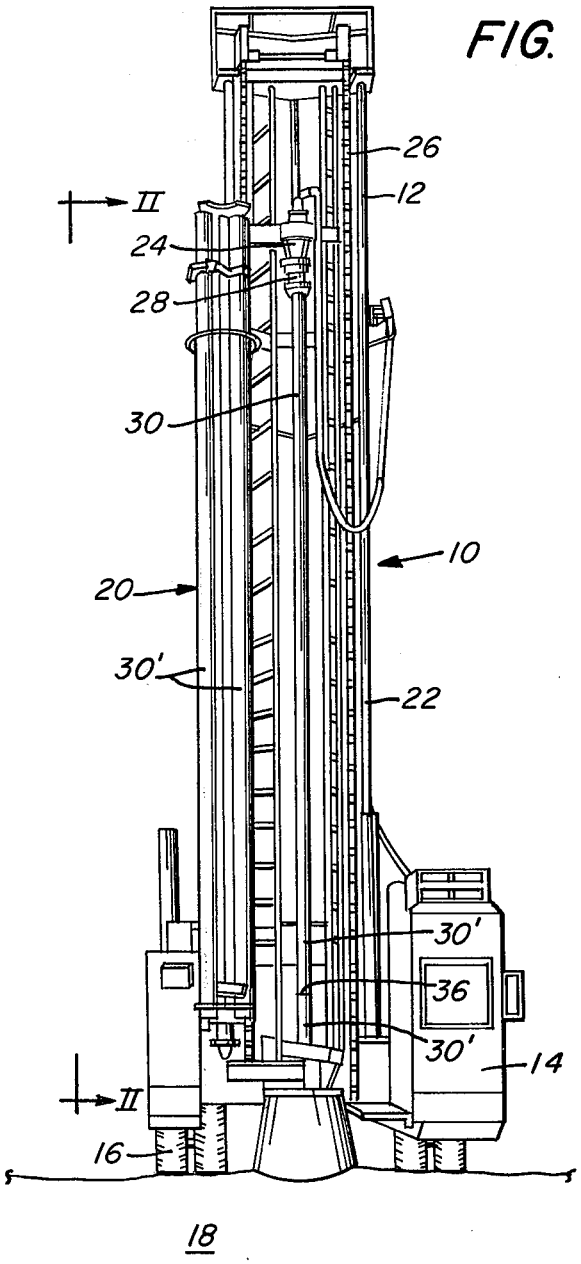
FIG. 1 illustrates in rear end elevation a mobile drilling apparatus including drill pipe storage and handling means constructed according to the principles of the present invention.

There is generally indicated at 10 in FIG. 1 a mobile drilling apparatus including drill pipe rack means generally indicated at 20 and constructed according to the principles of the present invention. In practice the apparatus 10 may take the form of any of various well known drilling rigs adapted to bore holes into the earth, but for purposes of simplification is shown herein as a known blast hole drill. Of course it is to be understood from the outset that such simplification is not intended to unduly limit the scope of the invention described.

As shown the apparatus 10 comprises an elongated drilling assembly 12 and adjustably carried by a mobile base 14 and movable with respect thereto in a well known manner as by fluid power means (not shown) or the like intermediate a generally vertical operative position as shown in FIG. 1 and a generally horizontal inoperative position (not shown). The base 14 may comprise for example any suitable powered mobile chassis such as a truck having traction and steering wheels as at 16 which render the apparatus 10 readily movable over terrain 18 and preferably over rough terrain such as is commonly encountered in such locations as open pit mines or quarries where the use of such drills may often be required. Inasmuch as such mobile bases are well known to those versed in the art further detailed description thereof is omitted herein. Applicant hereby refers to U.S. Pat. No. 3,181,630 for further description of one such mobile base.

As shown in FIG. 1 drilling assembly 12 comprises an elongated drill mast 22 which carries for longitudinal or axial movement therealong any suitable rotary drill motor assembly 24, a fluid motor for example. Mast 22 also carries motive means such as a known powered chain and sprocket assembly 26 adapted for orbital circulation intermediate the longitudinal ends of mast 22 and cooperable with motor assembly 24 for selective powered movement of the motor 24 axially of the mast 22 in the conventional manner.

Drill motor assembly 24 includes a drilling head portion 28 adapted to receive in rotary driving engagement the upper end of an elongated drill string 30 comprised of a plurality of elongated drill pipe sections 30' releasably joined end to end as at 36 by well known mating male and female threaded connections or the like. The drill string 30 carries adjacent the lower end thereof any suitable earth boring bit assembly (not shown) whereby actuation of the motor 24 and the chain and sprocket assembly 26 by suitable control means (not shown) imparts a rotary drilling action through the drill string 30 to the bit assembly for the purpose of drilling a hole into the earth in the customary manner.

In order to efficiently handle a drill string assembled from the drill pipe sections 30' the drilling assembly 12 further includes the drill pipe rack means 20 adjustably carried by mast 22 and adapted to carry a plurality of the drill pipe sections 30'.

Figure 2:
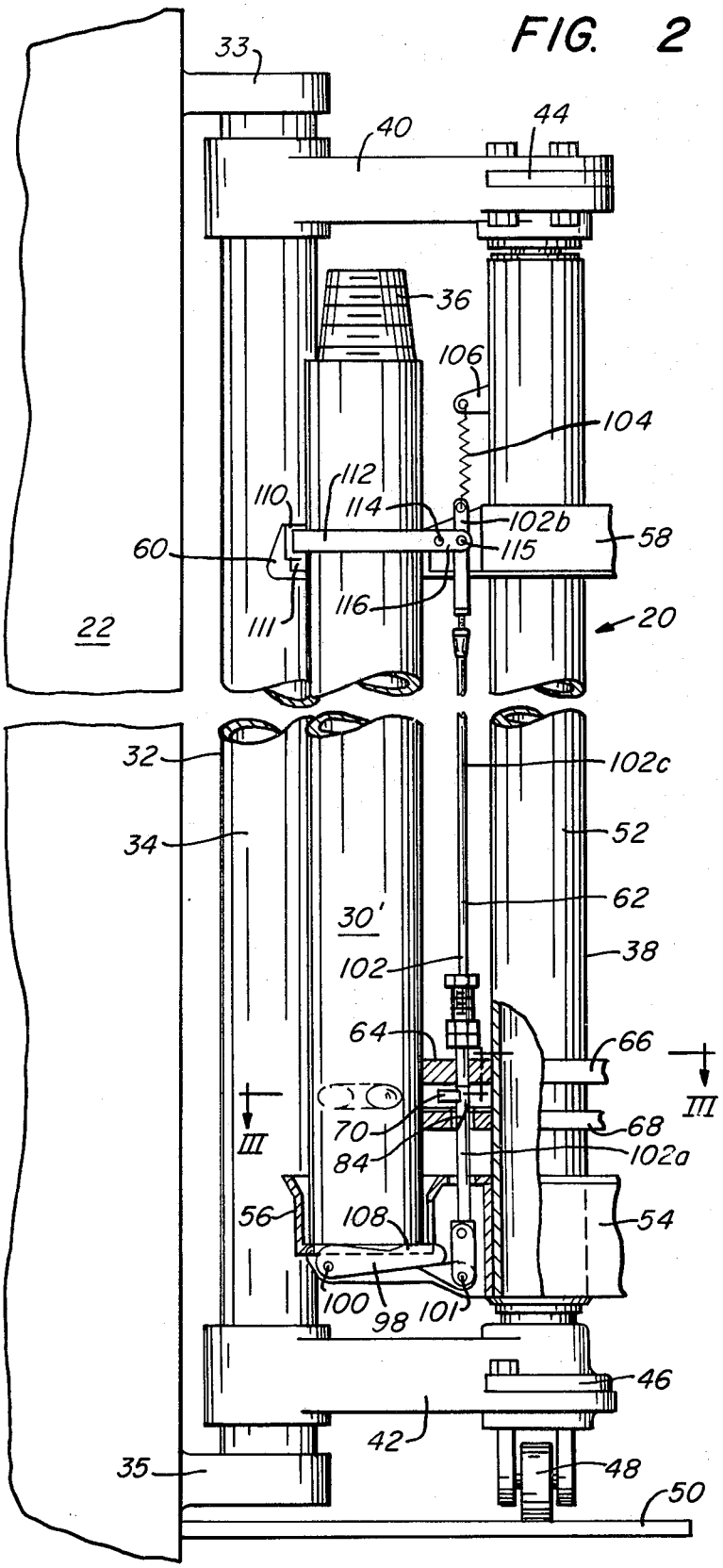
FIG. 2 illustrates partly in section a fragmentary portion of the drill pipe storage and handling means of this invention as seen from line 2—2 of FIG. 1.

As shown in FIGS. 1 and 2, rack means 20 comprises an elongated rack assembly 38 disposed adjacent one lateral side of the mast 22 and extending generally longitudinally with respect thereto. In practice the assembly 38 may be adapted to carry a plurality of drill pipe sections 30'; however, for purposes of simplification only the means for carrying one such pipe section are shown in detail in FIGS. 2 and 3. The assembly 38 is adjustably carried by mast 22 by a support means 32 shown as including an elongated support member 34 extending generally longitudinally of the mast 22 and journaled adjacent opposed longitudinal ends thereof for pivotal movement in suitable upper and lower rotative bearing assemblies 33 and 35, respectively, which are rigidly affixed to longitudinally spaced portions of the mast 22. Support 34 has rigidly affixed adjacent respective upper and lower end portions thereof rigid, laterally extending support arms 40 and 42, respectively, including suitable rotative bearing portions 44 and 46 disposed adjacent the outer or free end of each respective arm 40 and 42 and adapted to receive respective longitudinally opposed ends of the assembly 38. Support means 32 may further include a roller support assembly 48 rigidly affixed to the arm 42 subjacent bearing portion 46 and adapted to engage in rolling engagement a flat, plate-like support surface 50 rigidly affixed adjacent a lower portion of mast 22 whereby additional support for the assembly 38 is provided.

As is well known in the art, such adjustable rack supports as the means 32 may commonly include suitable power means not shown herein for pivoting member 34 to swing arms 40–42 laterally of mast 22, whereby the rack assembly 38 may be selectively adjusted intermediate a first position spaced laterally from the drill axis as shown in FIG. 1, and a second position (not shown) whereat the assembly 38 is positioned adjacent the drilling axis to supply or receive a drill pipe section 30'.

Figure 3:
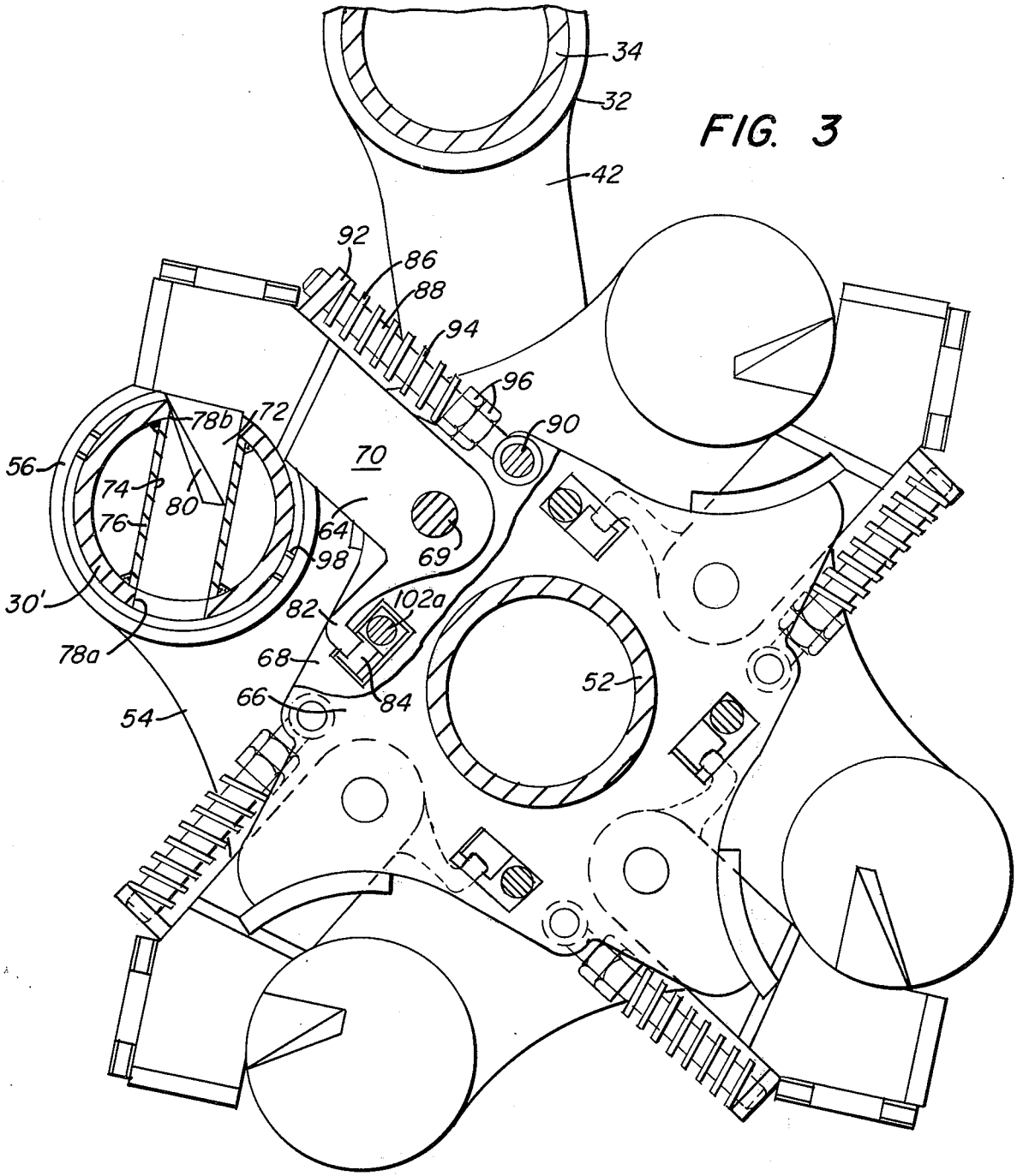
FIG. 3 is a partly schematic, transverse section taken on line 3—3 of FIG. 2.

As shown in FIGS. 2 and 3, the rack assembly 38 comprises an elongated central member 52 rotatably journaled adjacent respective opposed upper and lower longitudinal end portions thereof in the bearings 44 and 46 and adapted as by any suitable power means (not shown) for selective rotation with respect to the support means 32.

Member 52 has rigidly affixed adjacent a lower end portion thereof a lower drill pipe retaining member 54 comprised of a plurality of upwardly opening cups 56 spaced circumferentially about the member 52 and rigidly affixed with respect to each other. Each cup 56 is adapted to receive one end of a drill pipe section 30'. Member 52 additionally has rigidly affixed adjacent an upper end portion thereof an upper drill pipe retaining member 58 comprised of a plurality of retainer portions 60 spaced circumferentially about the member 52 and each axially aligned with a respective one of the cups 56 to receive an upper end portion of the respective pipe section 30'. The member 52 still further carries intermediate the retaining members 54 and 58 a drill pipe latch means 64 adapted to latch the drill pipe section 30' carried by the respective retainer 60 and cup 56, and comprised of a pair of longitudinally spaced apart support plates 66 and 68 rigidly affixed to the member 52 and having a plurality of latch elements 70 transversely pivotally affixed therebetween as at 69. Each of the elements 70 is disposed so as to be cooperable with one of the respective pairs of cups 56 and retainers 60 to engage the respective pipe section 30' as described hereinbelow.

Each element 70 includes a spring bias means 86 for biasing the elements 70 in a counterclockwise direction about pivot 69 (as viewed in FIG. 3) and comprising, as shown, an elongated rod 88 pivotally affixed adjacent one end thereof intermediate plates 66 and 68 as at 90 and extending laterally therefrom. The opposed end of rod 88 extends slidably within a spring retainer plate 92 rigidly affixed adjacent an outer end portion of the element 70, and a helical compression spring 94 is disposed coaxially of rod 88 and compressed intermediate plate 92 and any suitable retainer means spaced therefrom on the rod 88, for example jamming nuts 96, whereby the spring 94 continuously biases elements 70 in a counterclockwise direction about pivot 69.

Each element 70 further includes a projection 72 rigidly carried adjacent an outer end portion thereof and adapted to be received within a suitably positioned transverse opening 74 in the pipe section 30' to lock the pipe section in place. The opening 74 is shown as being formed by a diametrically extending tubular member 76 affixed within the pipe section 30' as by welding and communicating with diametrically opposed exterior portions of the pipe section 30' through diametrically opposed transverse bores 78a-78b within the wall of the pipe section 30'.

The projection 72 includes a cam surface 80 whereby, when the projection 72 is engaged within opening 74 the pipe section 30' is constrained against rotation in a counterclockwise direction (as viewed in FIG. 3) but is free to rotate in a clockwise direction inasmuch as the trailing curved portion of bore **78*b* will engage the correspondingly curved cam surface 80 in response to clockwise directed rotative force to drive projection 72 outwardly and rotate element 70 clockwise against the bias of spring means 86**.

The element 70 further includes a second projection 82 shown as extending generally radially outwardly from the pivot 69 and engagable by actuating means to be described hereinbelow for rotation of the element 70 in a clockwise direction against the bias of the spring means 86.

It will be seen by reference to FIG. 2 that the rack means 38 additionally includes a longitudinally extending actuator means 62 for cooperably actuating the latch means 64 and retainer means 60 in response to the placement of a drill pipe section 30' within the respective cup 56. The actuator 62 comprises a transverse actuator bar 98 pivotally affixed as at 100 adjacent an open lower end portion of the respective cup 56 and extending generally diametrically thereacross. The free end of bar 98 has pivotally affixed thereto as at 101 the lowermost end of an elongated actuating member 102 comprising a lower portion **102*a* for actuating the latch element 70 of latch 64, an upper portion 102*b* for actuating retainer 60, and an intermediate portion 102*c* comprised of an elongated member such as a flexible cable communicating between the portions 102*a* and 102*b*. A tension spring bias means 104 communicates intermediate an upper end of portion 102*b* and a spring retainer 106 spaced upwardly therefrom and rigidly affixed to the member 52. The spring means 104 provides an upward bias whereby the entire actuator member 102 is urged upwardly and the free end of bar 98 is consequently urged upwardly such that an upwardly extending protrusion 108 thereon projects into a lower portion of the cup 56**.

The actuator portion **102*a* includes a cam surface 84 cooperable with projection 82 for actuating the element 70 in the manner hereinabove described, and the portion 102*b* includes means for actuating the retainer 60 as follows. The retainer 60 comprises a rigid curved arm portion 110 adapted to partially encircle a drill pipe section 30' thereby defining an open side 111 of the retainer 60. A gate member 112 is pivotally affixed to an inner portion of retainer 60 as at 114 and includes an inwardly extending projection 116 which is pivotally affixed to the actuator portion 102*b* as at 115 whereby vertical movement of the actuator 102 in opposite directions pivotally moves gate 112 intermediate a closed position as shown in FIG. 2 whereat drill pipe section 30' is secured within the retainer 60, and an open position (not shown) whereat the pipe section 30'** is released.

From the foregoing description the operation of the present invention will be readily apparent. In practice each drill pipe section 30' is retained in rack means 20 by having the lower end thereof resting within one of cups 56 thereby engaging the projection 108 to urge bar 98 and member 102 downwardly against the upward bias of spring means 104. Accordingly, the member 102 is disposed in a lower position thereof whereby the cam surface 84 is disengaged from projection 82 such that the element 70 is urged by spring means 86 in a counterclockwise direction and projection 72 engages the respective opening 74 of pipe section 30'. Likewise, the gate 112 is disposed in the closed position as shown in FIG. 2 by extending laterally across the open side 111 of retainer 60. It will be seen that by this pipe retention arrangement the individual drill pipe section 30′ is retained not only against lateral movement by the cup 56 and retainer 60, but also against vertical movement by the disposition of the projection 72.

To remove such a retained drill pipe section 30′ from the rack means 20 for incorporation into the drill string, the rack assembly 38 and supports 32 are manipulated by suitable power means (not shown) to position the pipe section 30′ coaxially beneath the driving head 28. The head 28 is then lowered into contact with the drill pipe section to engage connector means 36, a right-hand threaded connector for example, and is rotated in a clockwise direction (as viewed in FIG. 3) to make up the connection. Upon complete makeup of the connection continued clockwise rotation of the head 28 also rotates pipe section 30′ clockwise to disengage the projection 72 from opening 74b in the manner hereinabove described whereby the pipe section 30′ is free to be lifted vertically upwardly from the cup 56. Upon such lifting of the drill pipe section 30′ the lower end thereof disengages projection 108 whereby bar 98 and actuator means 102 are released to move upwardly under the urging of spring 104. The cam surface 84 thus engages projection 82 to move the element 70 to the fully clockwise or unlocked position, and to pivot gate 112 downwardly to the open position thereby freeing the pipe section 30′ from retainer 60. The drill pipe section 30′ is thus released from rack means 20 and connected to the driving head 28 for incorporation into the drill string 30.

To return a drill pipe section 30′ to the rack means 20 the pipe section is disconnected from the remainder of the drill string 30 and is supported by head 28 laterally adjacent rack 20, and the rack 20 and adjustable supports 32 are manipulated to position the pipe section 30′ within one of the open retainers 60 and in axial alignment with the respective cup 56. The pipe section 30′ is then lowered into the respective cup 56 by selective axial movement of the drill motor assembly 24 to engage projection 108 whereby bar 98 and actuator 102 are moved downwardly against the upward bias of spring 104 to the position shown in FIG. 2. Responsive to the movement of actuator 102 the gate 112 is pivoted upwardly to secure the upper end of the pipe section within retainer 60, and the cam surface 84 releases projection 82 whereby spring means 86 urges element 70 in a counterclockwise direction such that projection 72 engages the exterior surface of the pipe section. Subsequent powered counterclockwise rotation of the driving head 28 rotates the pipe section thereby aligning the opening 74 with the projection 72 for locking engagement therebetween under the continuing urging of spring means 86. It will be seen from FIG. 3 that upon such locking engagement the pipe section is constrained against further counterclockwise rotation whereby additional counterclockwise rotative force may be applied by motor assembly 24 to break the connection 36 between the pipe section and the driving head 28. The pipe section is thus once again released from driving head and positively secured within rack means 20.

The rack means disclosed hereinabove has been found to provide improved drill pipe retention especially when the drill mast 22 and rack means 20 are lowered to the horizontal position for the purpose of relocating the drilling apparatus 10. In such case the projection 72 and the actuator means 62 associated therewith have been found to better perform the function of restraining the extremely heavy drill pipe section from longitudinal movement thus preventing accidental release of the drill pipe section as the drilling apparatus is being moved over rough terrain.

Notwithstanding the reference hereinabove to a specific preferred embodiment of the invention it is to be understood that this invention may be practiced in various alternative embodiments with numerous modifications thereto without departing from the broad spirit and scope thereof. For example, the physical configuration of the latch element 70 and gate 112 may be varied within a wide design latitude; the sense of rotation used to make and break drill pipe connections, and the configuration of cooperating elements such as the latch elements 70 may be reversed; the connections 36 need not necessarily be threaded connections; the rack means 20 need not necessarily be a circular magazine arrangement as shown; and the like.

These and other embodiments and modifications having been envisioned and anticipated by the inventors it is requested that this invention be interpreted broadly and limited only by the scope of the claims appended hereto.

What is claimed is:

1. A drill pipe storage rack comprising: a plurality of drill pipe support means, each of said support means including an upper drill pipe supporting assembly adapted to support an upper end portion of a drill pipe, a lower drill pipe supporting assembly adapted to support a lower end portion of such drill pipe and actuator means; each of said lower drill pipe supporting assemblies including latch means having a projection movable into a drill pipe contacting position in response to a drill pipe being lowered onto a portion of a respective one of said actuator means, and said projection movable into a drill pipe non-contacting position in response to a drill pipe being raised from said portion; said projection further positionable when in said contacting position between a release position wherein said projection contacts the outer periphery only of such drill pipe and a lock position wherein said projection extends within the outer periphery of such drill pipe.

2. The drill pipe storage rack as specified in claim 1 wherein each of said actuator means is cooperable with a respective one of said upper drill pipe supporting assemblies to move said respective upper supporting assembly into a drill pipe support position in response to such drill pipe being lowered onto a respective one of said portions and to move said respective upper supporting assembly out of said drill pipe support position when such drill pipe is raised from said one of said portions.

3. The drill pipe storage rack as specified in claim 1 wherein each said actuator means includes a spring for urging a respective one of said projections into said lock position from said release position when said one of said projections is in said contacting position.

4. The drill pipe storage rack as specified in claim 1 wherein each of said projections includes a cammed surface for moving a respective one of said projections from said lock position to said release position when said one of said projections is in said contacting position and only when a respective drill pipe is rotated in a given direction; and when said one of said projections is in said lock position such drill pipe is prevented from being rotated in the direction opposite said given direction.

5. The drill pipe storage rack as specified in claim 1 wherein said lower drill pipe supporting assembly includes means adapted to surround a drill pipe to limit the radial movement thereof.

6. The drill pipe storage rack as specified in claim 1 wherein each of said actuator means further comprises a linkage rod connected between a respective one of said portions and a respective one of said latch means; each of said linkage rods having a cam portion for controlling the movement of a respective one of said projections between said contacting and said non-contacting positions.

7. A drill pipe storage rack comprising: plurality of drill pipe support means, each of said support means including an upper drill pipe supporting assembly adapted to support an upper end portion of a drill pipe, a lower drill pipe supporting assembly adapted to support a lower end portion of such drill pipe and an actuator means; each of said lower drill pipe supporting assemblies including latch means movable in a generally horizontal plane into a drill pipe contacting position in response to a portion of a respective one of said actuator means being moved into a first position and said latch means movable in said plane into a drill pipe non-contacting position in response to movement of said portion being moved into a second position.

8. The drill pipe storage rack as specified in claim 7 wherein each of said actuator means is connected with a respective one of said upper drill pipe supporting assemblies to move said one upper assembly into a drill pipe support position in response to said portion of a respective one of said actuator means being moved into said first position and to move said one upper assembly out of said drill pipe support position in response to said portion of a respective one of said actuator means being moved into said second position.

* * * * *